US007033486B2

(12) United States Patent
Gorbaty et al.

(10) Patent No.: US 7,033,486 B2
(45) Date of Patent: Apr. 25, 2006

(54) RESIDUUM CONVERSION PROCESS

(75) Inventors: Martin L. Gorbaty, Westfield, NJ (US); Michael Siskin, Randolph, NJ (US); Mitchell Jacobson, Fairfax, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 591 days.

(21) Appl. No.: 10/368,186

(22) Filed: Feb. 18, 2003

(65) Prior Publication Data

US 2003/0221992 A1 Dec. 4, 2003

Related U.S. Application Data

(60) Provisional application No. 60/369,138, filed on Apr. 1, 2002.

(51) Int. Cl.
*C10G 11/14* (2006.01)

(52) U.S. Cl. ..... 208/113; 208/106; 208/127; 585/648

(58) Field of Classification Search ..... 208/106, 208/113, 127; 585/648
See application file for complete search history.

(56) References Cited

U.S. PATENT DOCUMENTS

| | | | | |
|---|---|---|---|---|
| 4,497,705 | A | 2/1985 | Weinberg et al. | 208/127 |
| 5,658,455 | A | 8/1997 | Hammond et al. | 208/127 |
| 5,714,056 | A | 2/1998 | Hammond et al. | 208/127 |
| 5,714,663 | A | 2/1998 | Serrand et al. | 585/648 |
| 6,241,874 | B1 | 6/2001 | Wallace et al. | 208/45 |

FOREIGN PATENT DOCUMENTS

| | | |
|---|---|---|
| WO | 97 31083 | 8/1997 |
| WO | 00 63320 | 10/2000 |
| WO | 01 83643 A | 8/2001 |

*Primary Examiner*—Tam M. Nguyen
(74) *Attorney, Agent, or Firm*—Erika S. Wilson; Jeremy J. Kliebert

(57) ABSTRACT

The present invention relates to a process for increasing the capacity for processing residua and obtaining higher yields of liquids having an average boiling point equal to or less than about 510° C. A residual feedstock is introduced with recycled product asphaltenes into a short vapor contact time thermal process unit wherein the vaporized product is sent to a fractionator zone to produce a 510° C.$^-$ fraction and a 510° C.$^+$ fraction. The 510° C.$^+$ fraction is sent to a solvent extraction zone to produce an asphaltene-rich fraction that is recycled to the short vapor contact time thermal process unit.

14 Claims, 1 Drawing Sheet

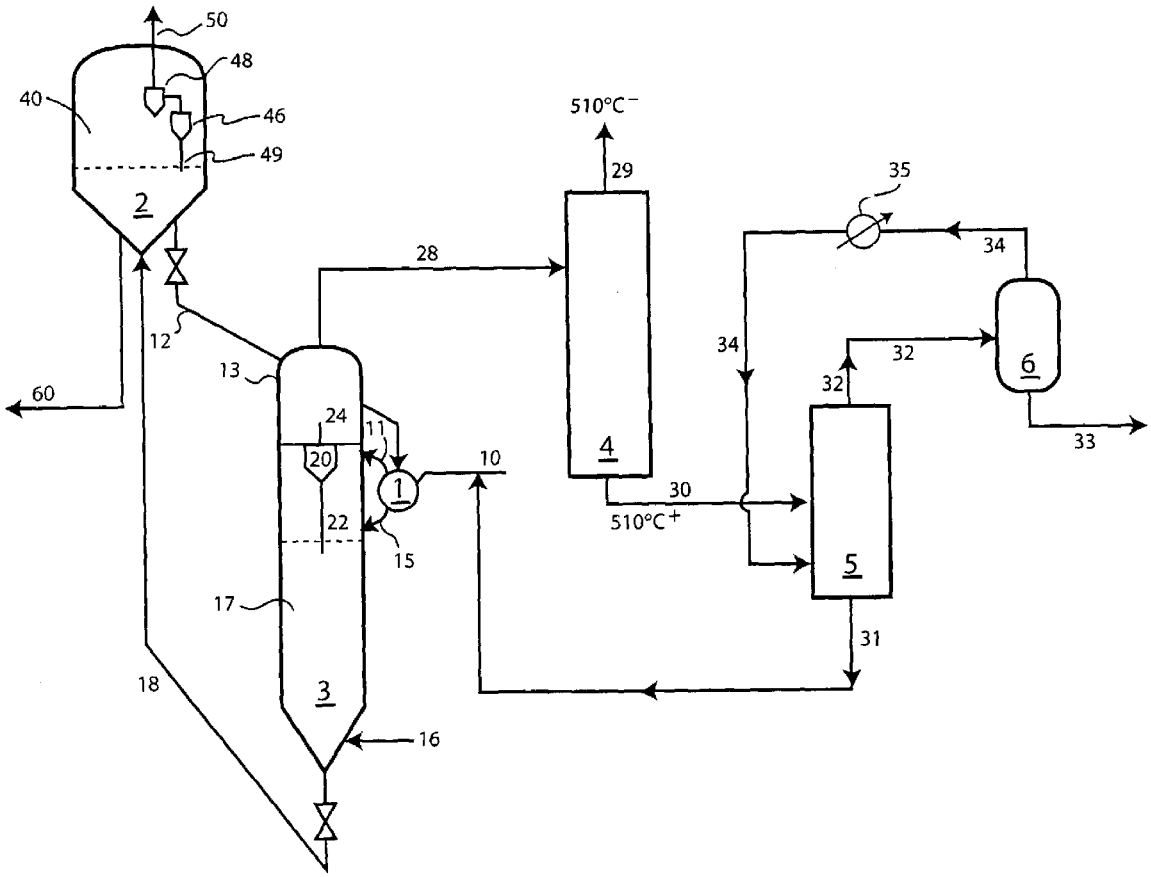
50
48
40
46
49
2
510°C⁻
29
35
28
34
12
13
34
32
32
6
60
24
11
20
10
1
4
30
510°C⁺
22
15
5
17
31
18
3
16

RESIDUUM CONVERSION PROCESS

CROSS-REFERENCE TO RELATED APPLICATION

This application claims benefit of U.S. provisional patent application Ser. No. 60/369,138 filed Apr. 1, 2002.

FIELD OF THE INVENTION

The present invention relates to a process for increasing the capacity for processing residual and obtaining higher yields of liquids having an average boiling point equal to or less than about 510° C. A residuall feedstock is introduced with recycled product asphaltenes into a short vapor contact time thermal process unit wherein the vaporized product is sent to a fractionator zone to produce a 510° C.$^-$ fraction and a 510° C.$^+$ fraction. The 510° C.$^+$ fraction is sent to a solvent extraction zone to produce an asphaltene-rich fraction that is recycled to the short vapor contact time thermal process unit.

BACKGROUND OF THE INVENTION

Transportation fuels, such as gasolines, diesel fuels, and jet fuels, as well as light heating oils, are high-volume, high value refinery products. While light heating oils are not transportation fuels, their hydrocarbon components are usually interchangeable with diesel and jet fuels, differing primarily in their additives. Thus, it is a major objective of petroleum refineries to convert as much of a barrel of crude oil into transportation fuels as is economically practical. The quality of crude oils is expected to slowly worsen with increasing levels of sulfur and metals content and higher densities. Higher densities mean that more of the crude oil will boil above about 560° C., and thus will contain higher levels of Conradson Carbon and/or metal components. Historically, this high-boiling material, or residual, has been used as heavy fuel oil, but the demand for these heavy fuel oils has been decreasing because of stricter environmental regulations. This places a greater demand on refineries to convert as much of a barrel of crude as possible to more valuable lower boiling products.

In a typical refinery, crude oils are subjected to atmospheric distillation to separate lighter materials such as straight run naphtha, gasolines, kerosenes, gas oils, etc. from the heavier materials. The residue from atmospheric distillation is then distilled at a pressure below atmospheric pressure. This latter distillation step produces a vacuum gas oil distillate and a vacuum reduced residuall oil that often contains relatively high levels of asphaltene molecules. These asphaltene molecules usually contain most of the coke forming and metal components of the resid. They also contain relatively high levels of heteroatoms, such as sulfur and nitrogen. Such residual feeds have lower commercial value, primarily because they cannot be used as transportation fuel or as heating oil because of ever stricter environmental regulations. They also have lower value as feedstocks for refinery processes, such as fluid catalytic cracking, because they produce excessive amounts of gas and coke. In addition, their high metals and heteroatom content leads to catalyst deactivation. Thus, there is a need in petroleum refining to upgrade residuall feeds to more valuable cleaner and lighter products.

There are a number of processes used for recovering the lighter components from various asphaltic petroleum residual feeds. Some of these processes involve the extraction of the lighter components with a deasphalting solvent, and thereafter separating and recovering the lighter components from the solvent. The solvent utilized is a liquefied, but normally gaseous, solvent, such as propane, which is maintained at a temperature between about 38° C. (100° F.) and 121° C. (250° F.) and at a pressure sufficient to maintain the solvent in a liquid phase. While propane is often used in conventional solvent deasphalting operations, other solvents such as butane, pentane, hexane, and mixtures thereof have also been suggested.

Typically, solvent deasphalting is followed by processing the deasphalted oil in a hydrotreater and catalytic cracker, while the asphaltenes are processed in a delayed or fluid coker. While such processes have met with commercial success, there is nevertheless a continuing need in the art for an enhanced deasphalting process, which results in higher liquid yields and an increased capacity for processing residual.

SUMMARY OF THE INVENTION

In accordance with the present invention there is provided a process for converting a residuall feedstock to lower boiling fractions, at least one of which is a liquid fraction having a boiling point equal to or less than about 510° C., which process comprises converting the feedstock in a process unit comprised of:

(i) a heating zone wherein solids containing carbonaceous deposits are received from a stripping zone and heated in the presence of an oxidizing gas;

(ii) a short vapor contact time reaction zone containing a horizontal moving bed of fluidized hot solids recycled from the heating zone, which reaction zone is operated at a temperature from about 450° C. to about 700° C. and operated under conditions such that substantially all of the solids that are passed from the heating zone pass through the reaction zone and wherein the solids residence time is from about 5 to about 60 seconds, and the vapor residence time is about 0.5 to about 2 seconds; and (iii) a stripping zone through which solids having carbonaceous deposits thereon are passed from the reaction zone and wherein lower boiling additional hydrocarbon and volatiles are recovered with a stripping gas.

which process comprises:

(a) feeding the residuall feedstock to the short vapor contact time reaction zone wherein it contacts the fluidized hot solids thereby resulting in high Conradson Carbon components and metal-containing components being deposited onto said hot solids, and a vaporized fraction;

(b) separating at least a portion of the vaporized fraction from the solids which vaporized fraction contains asphaltenes;

(c) passing the solids to said stripping zone where they are contacted with a stripping gas, thereby removing volatile components therefrom;

(d) passing at least a portion of the stripped solids to a heating zone where they are heated to an effective temperature that will maintain the operating temperature of the short vapor contact time reaction zone;

(e) recycling at least a portion of the heated solids from the heating zone to the short vapor contact reaction zone where they are contacted with fresh feedstock;

(f) passing at least a portion of the vaporized fraction separated in step(b) to a fractionation zone wherein a 510° C.$^+$ fraction and a 510° C.$^-$ fraction are separated from the vaporized fraction;

(g) passing said 510° C.$^+$ fraction to a solvent extraction zone wherein it is contacted with a solvent effective to produce an extract fraction and asphaltene-rich fraction; and (h) passing said asphaltene-rich fraction to the short vapor contact reaction zone.

In preferred embodiments of the present invention the residence time in the reaction zone for the solids is about 10 to 30 seconds and the residence time for the vapor is less than 1 second.

In other preferred embodiments of the present invention, the feedstock is selected from the group consisting of vacuum resids, atmospheric resids, heavy and reduced petroleum crude oil, pitch, asphalt, bitumen, tar sand oil, shale oil, coal slurries, and coal liquefaction bottoms.

In still other preferred embodiments of the present invention, the solvent in the solvent extraction zone is selected from the group consisting of propane, butane pentane, hexane, and naphtha.

In still other preferred embodiments of the present invention, the reaction zone is fluidized with the aid of both a mechanical means and a fluidizing gas comprised of vaporized normally gaseous hydrocarbons, hydrogen, hydrogen sulfide, and steam.

BRIEF DESCRIPTION OF THE FIGURE

The sole FIGURE thereof is a schematic flow plan of a non-limiting preferred embodiment of the present invention.

DETAILED DESCRIPTION OF THE INVENTION

The inventors have found unexpected results that recycling a portion of a bottoms asphaltene cut does not adversely affect the desired liquid product slate of short vapor contact time coking of a resid. The inventors have also unexpectedly found that the recycle stream can be significantly reduced, thus allowing for the recovery of substantially more 510° C.$^+$ fraction as potential feed for a catalytic cracker.

Residual feedstocks, which are upgraded in accordance with the present invention, are those petroleum fractions boiling above about 300° C., preferably above about 480° C., more preferably above about 540° C. Non-limiting examples of such feedstocks include vacuum resids, atmospheric resids, heavy and reduced petroleum crude oil; asphalt; bitumen; tar sand oil; shale oil; coal slurries; and coal liquefaction bottoms. It is understood that such feedstocks may also contain minor amount of lower boiling material. These feedstocks cannot be fed in substantial quantities to refinery process units, such as FCC units because they are typically high in Conradson Carbon and contain an undesirable amount of metal-containing components. Conradson Carbon residues will deposit on the FCC cracking catalyst and cause excessive deactivation. Metals, such as nickel and vanadium will also deactivate the catalyst by acting as catalyst poisons. Such feeds will typically have a Conradson carbon content of at least 5 wt. %, generally from about 5 to 50 wt. %. Determination of Conradson carbon residue is defined in ASTM Test D189-165.

Reference is now made to the sole FIGURE thereof wherein a residuall feedstock, which is high in Conradson Carbon and/or metal-component, is fed via line 10 to one or more short vapor contact time reaction zones 1 which contain a bed of hot solids. The solids can be moved in the short vapor contact time reactor by any suitable means, such as by use of a gas, such as steam, a mechanical means, or by the vapors which result from the vaporization of a fraction of the feedstock or product. It is preferred that the solids be moved by mechanical means and that the mechanical means be a mechanical mixing system characterized as having a relatively high mixing efficiency with only minor amounts of axial backmixing. Such a mixing system acts like a plug flow system with a flow pattern that ensures that the residence time is nearly equal for all particles. The most preferred mechanical mixing system is the mixer referred to by Lurgi AG of Germany as the LR-Mixer or LR-Flash Coker which was originally designed for processing solids such as oil shale, coal, and tar sands. The LR-Mixer consists of two horizontally oriented rotating screws that aid in fluidizing the solids. Although it is preferred that the solid particles be coke particles, they may be any other suitable refractory particulate material. Non-limiting examples of such other suitable refractory materials include those selected from the group consisting of silica, alumina, zirconia, magnesia, a mullite, synthetically prepared or naturally occurring material such as pumice, clay, kieselguhr, diatomaceous earth, bauxite, and the like. It is within the scope of the present invention that the solids can be inert or have catalytic properties. The solids will have an average particle size of about 40 microns to 2,000 microns, preferably from about 50 microns to about 800 microns.

When the feedstock is contacted with the hot solids, which will preferably be at a temperature from about 450° C. to about 700° C., more preferably from about 550° C. to 650° C., a substantial portion of the high Conradson Carbon and metal-containing components will deposit on the hot solid particles in the form of high molecular weight carbon and metal moieties. The remaining portion will be vaporized on contact with the hot solids. The residence time of vapor products in reaction zone 1 will be an effective amount of time so that substantial secondary cracking does not occur. This amount of time will typically be about 0.5 to about 3 seconds, preferably less than about 1 second. The residence time of solids in the reaction zone will be from about 5 to 60 seconds, preferably from about 10 to 30 seconds. The residence time of the solids and the residence time of the vapor products, in the reaction zone, are independently controlled. It is preferred that the short vapor contact time process unit be operated so that the ratio of solids to feed be from about 10 to 1, preferably from about 5 to 1. It is to be understood that the precise ratio of solids to feed will primarily depend on the heat balance requirement of the short vapor contact time reaction zone. Associating the oil to solids ratio with heat balance requirements is within the skill of those having ordinary skill in the art, and thus will not be elaborated herein any further. A minor amount of the feedstock will deposit on the solids in the form of combustible carbonaceous material. Metal components will also deposit on the solids. Consequently, the vaporized portion will be substantially lower in both Conradson Carbon and metals when compared to the original feed.

The vaporized fraction is passed via line 11 to cyclone 20 where most of the entrained solids, or dust, is removed. The dedusted vapors are then passed to quench zone 13 via line 24 where the vapors are reduced to temperatures below which substantial thermal cracking occurs. This temperature will preferably be below about 450° C., more preferably below about 340° C. Solids, having carbonaceous material deposited thereon, are passed from reaction zone 1 via lines 15 to the bed of solids 17 in stripper 3. The solids pass downwardly through the stripper and past a stripping zone at the bottom section where at least a portion, and substantially all of any remaining volatiles, or vaporizable material, are stripped from the solids with use of a stripping gas, preferably steam, introduced into the stripping zone via line 16. The stripped solids are passed via line 18 to heater 2 which contains a heating zone. The heating zone is operated in an oxidizing gas environment, preferably using air, at an effective temperature. That is, at a temperature that will meet the heat requirements of the reaction zone. The heating zone will typically be operated at a temperature of about 40° C. to 200° C., preferably from about 65° C. to 175° C., more preferably from about 65° C. to 120° C. in excess of the operating temperature of reaction zones 1. It is understood that preheated air can be introduced into the heater. The heater will typically be operated at a pressure ranging from about 0 to 150 psig, preferably at a pressure ranging from about 15 to about 45 psig. While some carbonaceous residue will be burned from the solids in the heating zone, it is preferred that only partial combustion take place so that the solids, after passing through the heater, will have value as a fuel. Excess solids can be removed from the process unit via line 60. Flue gas is removed overhead from heater 2 via line 50 after it is passed through a cyclone system 46 and 48 to remove solid fines which are returned to heater 2 via dipleg 49. Dedusted flue gas can be further cooled in a waste heat recovery system (not shown), scrubbed to remove contaminants and particulates, and passed to a CO boiler (not shown). The hot inert solids are then recycled via lines 12 to reaction zone 1.

The stripped vapor products pass upwardly in stripper vessel 3, through line 22 to cyclone 20 to quench zone 13 via line 24 where a product stream, containing a substantial amount of olefins, is removed via line 28 and passed to fractionation zone 4 that is operated at conditions to result in a 510° C.$^-$ fraction and a 510° C.$^+$ fraction. Any remaining solids are returned to the bed of solids 17 via dipleg 22. The 510° C.$^-$ fraction is collected overhead via line 29. A heavy stream comprised of the 510° C.$^+$ fraction descends to the bottom of the fractionator and is collected via line 30 and passed to solvent extraction zone 5. The 510° C.$^+$ fraction will contain at least about 90 wt. %, preferably at least about 95 wt. %, and more preferably substantially all of the asphaltene fraction of the product stream. It may also contain most of the polar components of the product stream. The 510° C.$^+$ fraction is contacted in extraction zone 5 with an effective solvent to produce an extract fraction and asphaltene-rich fraction. The solvent extraction zone can also be referred to as a solvent deasphalter since a suitable solvent is used that will extract components from the 510° C.$^+$ stream that are soluble in the solvent, leaving an asphaltene rich fraction. It is preferred that a solvent be used at effective temperature and pressure conditions that will leave a fraction that is substantially comprised of asphaltenes.

The solvent deasphalting and solvent extraction used herein are conventional. Non-limiting examples of solvents suitable for use herein include propane, butane, pentane, hexane, naphtha, or mixtures thereof, more preferred is propane. Asphaltenes, which typically have a high molecular weight, are largely insoluble in propane. The 510° C.$^+$ fraction is preferably contacted with solvent, at temperatures ranging from about 38° C. (100° F.) to 121° C. (250° F.), preferably from about 50° C. (122° F.) to 100° C. (212° F.). The asphaltenes will typically precipitate and/or phase separate from the extract producing an asphaltene-rich fraction. This asphaltene-rich fraction is recycled to the short vapor contact reaction zone 1 via line 31. The extract fraction is passed via line 32 to a solvent recovery zone 6 where the deasphalted oil is separated from the solvent stream by any suitable means. The deasphalted oil can be collected via line 33 and sent to further processing such as a fluid catalytic cracker (not shown), it also can be blended with a vacuum gas oil and sent to a fluid catalytic cracker (not shown), or it can be sent to a hydrotreating zone and then to a fluid catalytic cracker (not shown). The solvent stream is sent to condenser 35 and recycled to the solvent extraction zone 5 via line 34.

The following examples are presented for illustrative purposes only and are not to be taken as limiting the present invention in any way.

EXAMPLES

Preparation of Asphaltene Sample 500 g of n-pentane was mixed with 50 g 510° C.$^+$ liquid obtained from a vacuum resid that was processed in a pilot plant size short-vapor contact time coking unit. The mixture was stirred at room temperature (≅22° C.) overnight then filtered through a medium porosity fritted glass filter. 18.09 g (36 wt. % of original 510° C.$^+$ feed) of n-pentane insoluble material (asphaltene sample) was recovered. 31.14 g (62 wt. % of original 510° C.$^+$ feed) of n-pentane soluble material remained. 0.77 g (1–2 wt. %) was lost in handling.

Example 1 (Comparative)

1.5 g of the asphaltene sample prepared in accordance with the above procedure was charged to a MicroCarbon Residue Testing Unit (MCRTU, ASTM D4530) under a nitrogen atmosphere. The temperature was ramped from room temperature to 550° C. over thirty minutes and held at 550° C. for twenty minutes under a flow of nitrogen. Volatile liquid products were collected in a glass collection tube immersed in dry ice. Product bottoms were weighed and product liquids were isolated and analyzed. This resulted in a yield of 0.5 g of bottoms and 0.90 g of overhead liquids. The remainder was gas and was not measured.

Example 2 (Comparative)

The procedure of Example 1 above was followed except 1.66 g of Arab Light Vaccum Resid (ALVR) was charged to the MicroCarbon Residue Testing Unit. 0.28 g of bottoms and 1.21 g of overhead liquids were recovered. The liquids were analyzed and the results are set forth in the table below.

Example 3

The procedure of Example 1 above was followed except that a 1.66 g sample comprised of a blend of 90 wt. % ALVR and 10 wt. % asphaltene sample as prepared above was used. This resulted in a yield of bottoms of 0.36 g and a yield of liquids of 1.20 g. The liquid fractions from both runs were analyzed. The results are also shown in the table below.

| | Example 2 (Comparative) (ALVR) | Example 3 90 wt. % ALVR + 10 wt. % Asphaltene Sample |
|---|---|---|
| % Volatiles | 83.1 | 81.4 (78.3)[a] |
| % Bottoms | 16.9 | 18.6 (21.7)[a] |
| Liquids % C | 85.54 | 85.49 |
| % H | 11.10 | 11.07 |

-continued

| | Example 2 (Comparative) (ALVR) | Example 3 90 wt. % ALVR + 10 wt. % Asphaltene Sample |
|---|---|---|
| % N | <0.5 | <0.5 |
| % S | 3.01 | 3.57 |
| H/C | 1.54 | 1.54 |
| Ni (ppm) | 2.0 | 2.0 |
| V (ppm) | 3.0 | 1.5 |
| C aliphatic ($^{13}$C nmr) | 69.5 | 68.5 |
| C aromatic ($^{13}$C nmr) | 30.5 | 31.5 |
| HPLC-2 Data on Liqs. | | |
| Saturates | 30.89 | 30.45 |
| 1 Ring Aromatics | 12.58 | 12.13 |
| 2 Ring Aromatics | 13.71 | 13.27 |
| 3 Ring Aromatics | 8.68 | 8.81 |
| 4 Ring Aromatics | 14.89 | 15.19 |
| Polars | 19.25 | 20.16 |

[a]Data from repeat experiment

The data in this table evidences that the volatiles made in short vapor contact time coking from a feed comprised of a blend of 90 wt. % resid and 10 wt. % asphaltene sample (derived from a 510° C.$^+$ short vapor contact time coking unit) are slightly lower than those from 100 wt. % resid. Based on this data, there does not appear to be either a positive or negative synergy between processing the resid alone versus in mixture with a bottoms asphaltene sample. Thus, the addition of the asphaltene recycle does not significantly adversely affect the desired liquid product slate from short vapor contact time coking of a vacuum resid.

More important is that the process allows recovery of more than 60% of the 510° C.$^+$ as potential feed for a catalytic cracker, adding to the overall liquid yield credits. This also means that the recycle stream to the coker is reduced from 30–45% to only about 5–10%. Therefore, significant investment and energy savings are achieved, since the coker will be smaller than if the entire 510° C.$^+$ fraction had to be returned to it.

The invention claimed is:

1. A process for converting residual feedstocks to lower boiling fractions, one of which is a liquid fraction having a boiling point equal to or less than about 510° C., which process comprises converting the feedstocks in a process unit comprised of:

(i) a heating zone wherein solids containing carbonaceous deposits are received from a stripping zone and heated in the presence of an oxidizing gas;

(ii) a short vapor contact time reaction zone containing a horizontal moving bed of fluidized hot solids recycled from the heating zone, which reaction zone is operated at a temperature from about 450° C. to about 700° C. and operated under conditions such that substantially all of the solids that are passed from the heating zone pass through the reaction zone and wherein the solids residence time is from about 5 to about 60 seconds, and the vapor residence time is about 0.5 to about 3 seconds; and (iii) a stripping zone through which solids having carbonaceous deposits thereon are passed from the reaction zone and wherein lower boiling additional hydrocarbon and volatiles are recovered with a stripping gas, which process comprises:

(a) feeding the residual feedstock to the short vapor contact time reaction zone wherein it contacts the fluidized hot solids thereby resulting in high Conradson Carbon components and metal-containing components being deposited onto said hot solids, and a vaporized fraction;

(b) separating at least a portion of the vaporized fraction from the solids which vaporized fraction contains asphaltenes;

(c) passing the solids to said stripping zone where they are contacted with a stripping gas, thereby removing volatile components therefrom;

(d) passing at least a portion of the stripped solids to a heating zone where they are heated to an effective temperature that will maintain the operating temperature of the short vapor contact time reaction zone;

(e) recycling at least a portion of the heated solids from the heating zone to the short vapor contact reaction zone where they are contacted with fresh feedstock;

(f) passing at least a portion of the vaporized fraction separated in step (b) to a fractionation zone wherein a 510° C.$^+$ fraction and a 510° C.$^-$ fraction are separated from the vaporized fraction;

(g) passing said 510° C.$^+$ fraction to a solvent extraction zone wherein it is contacted with a solvent effective to produce an extract fraction and asphaltene-rich fraction; and (h) passing said asphaltene-rich fraction to the short vapor contact reaction zone.

2. The process of claim 1 wherein the vapor residence time of the short vapor contact time reaction zone is less than about 1 second.

3. The process of claim 2 wherein the solids residence time of the short vapor contact time reaction zone is from about 10 to 30 seconds.

4. The process of claim 1 wherein the particles of the short vapor contact time reaction zone are moved with the aid of a mechanical means.

5. The process of claim 4 wherein the mechanical means are comprised of set of horizontally disposed screws within the reactor.

6. The process of claim 1 wherein the residual feedstock is chosen from the group consisting of vacuum resids, atmospheric resids, heavy and reduced petroleum crude oil, pitch, asphalt, bitumen, tar sand oil, shale oil, coal slurries, and coal liquefaction bottoms.

7. The process of claim 6 wherein the most preferred feedstock is vacuum resids.

8. The process of claim 1 wherein the solvent in the solvent extraction zone is selected from propane, butane pentane, hexane, naphtha, or mixtures thereof.

9. The process of claim 1 wherein the extract is sent to a separation zone to produce deasphalted oil and a recovered solvent stream.

10. The process of claim 9 wherein the recovered solvent stream is recycled to the solvent extraction zone.

11. The process of claim 9 wherein the deasphalted oil is sent to a fluid catalytic cracking unit.

12. The process of claim 9 wherein the deasphalted oil is sent to a hydrotreating zone and then to a fluid catalytic cracker.

13. The process of claim 9 wherein the deasphalted oil is blended with vacuum gas oil then sent to a fluid catalytic cracking unit.

14. The process of claim 9 wherein the deasphalted oil is blended with vacuum gas oil then sent to a hydrotreating zone and then to a fluid catalytic cracking unit.

* * * * *